United States Patent [19]

Miesel

[11] Patent Number: 4,721,309

[45] Date of Patent: Jan. 26, 1988

[54] LOTTERY NUMBER SELECTION DEVICE AND WAGERING KIT

[76] Inventor: Gary L. Miesel, 1636 Plain, NE., Canton, Ohio 44714

[21] Appl. No.: 918,073

[22] Filed: Oct. 14, 1986

[51] Int. Cl.[4] ..... A63F 3/08

[52] U.S. Cl. ..... 273/148 R; 235/88 G

[58] Field of Search ..... 273/148 R; 235/78 G, 235/88 G, 116, 122

[56] References Cited

U.S. PATENT DOCUMENTS 4,369,357 1/1983 Williams ..... 235/78 G

FOREIGN PATENT DOCUMENTS 46578 9/1951 Italy ..... 273/148 R 567307 9/1975 Switzerland ..... 273/148 R

*Primary Examiner*—Anton O. Oechsle

*Attorney, Agent, or Firm*—Oldham, Oldham & Weber Co.

[57] ABSTRACT

A device for selecting lottery numbers is described, including a folio kit in which the device is mounted and stored, together with other lottery wagering paraphernalia and related items. The device comprises a base on which concentric circles of numbers are displayed, together with a rotatable disc perforated with windows, the base and disc being fastened together at their respective centers. Windows on the base are covered with a transparent film on which various designs are imprinted in a variety of colors. Numbers are obtained by rotating the disc to a chosen reference point on the base, selecting a particular design and color, and observing the numbers displayed in the windows, and within the design color decided upon.

7 Claims, 4 Drawing Figures

LOTTERY NUMBER SELECTION DEVICE AND WAGERING KIT

TECHNICAL FIELD

This invention relates to a gaming device. More particularly, this invention relates to a device for selecting numbers on which wagers are to be subsequently placed, and to a folio kit in which it may be contained. Specifically, this invention concerns a window-containing disc, rotatable relative to a series of numbers arranged in circular fashion on a base to which the disc is attached, thus enabling players to systematically, visually select multiple digit numbers through such windows. In a preferred embodiment, the device is mounted in a folio cover, which contains instructions, filing means, and other paraphernalia required to assist players in selecting and keeping track of wagers, and in organizing and storing the cards, tickets, and other material associated therewith.

BACKGROUND OF THE INVENTION

In an effort to raise revenues to help fund ever increasing expenses, many states have turned to official lotteries as a convenient way in which to obtain money for operating purposes. While such lotteries take various forms, a popular version involves the selection of multi-digit numbers on which wagers are placed. A player arbitrarily chooses the number on which he wishes to wager, marks it on a lottery card provided for the purpose by the lottery ticket selling agent, and gives the card, together with money representing the wager, to the agent who then supplies the player with a ticket receipt.

Winning numbers are thereafter randomly chosen by the operator of the game by any of various means, and published for the information of participating players. Winners are able to collect their winnings simply by tendering a ticket receipt on which the chosen member is printed to a lottery game agent.

As may be imagined, number choices are commonly made by use of a wide variety of methods, including intuition, the selection of numbers having special meaning to the players, and in various other ways. Some players have difficulty in choosing numbers, however, and many of these feel a need for assistance in making a choice.

DISCLOSURE OF THE INVENTION

In light of the foregoing, a first aspect of this invention is to provide a number selection device for choosing numbers on which wagers are to be placed in a lottery game.

Another aspect of this invention is to provide a means for organizing and storing lottery ticket receipts, recording wagers, and for similar purposes, as well as for mounting the number selection device.

A further aspect of this invention is to provide a lottery wagering kit in the form of a readily transportable folio which provides assistance to players wishing to participate in playing lottery games.

A still further aspect of the invention described herein is to make available to lottery players a number selection device which makes the selection of wager numbers a semi-systemtized process, providing players with the reassurance that their selection involves some methodology, as opposed to a totally capricious choice.

The foregoing and other aspects of the invention which will become apparent as the detailed description proceeds, are achieved in a number selection device comprising in combination:

a base on which numbers are printed in a plurality of concentric circles, at least some of said members being radially aligned, and a disc having a plurality of window openings therein, comprising elongated, radially disposed window openings covered with a transparent film, the film over said elongated window openings being furnished with a plurality of different designs disposed radially thereon, certain of said designs appearing in a color different from the color of certain other of said designs, wherein said disc has a number indicator on its periphery, said disc being of smaller diameter than the outermost concentric circle of numbers on said base, and wherein said base and said disc are rotatably connected relative to each other at their respective centers, said base, window openings, designs and numbers being so located relative to each other that numbers on the base may be made to appear for observation within said window openings and within said designs when said disc is properly mechanically rotated relative to said base.

BRIEF DESCRIPTION OF THE DRAWINGS

The invention will be better understood when reference is had to the acompanying drawings forming a part hereof in which.

BEST MODE FOR CARRYING OUT THE INVENTION

Figure 1:
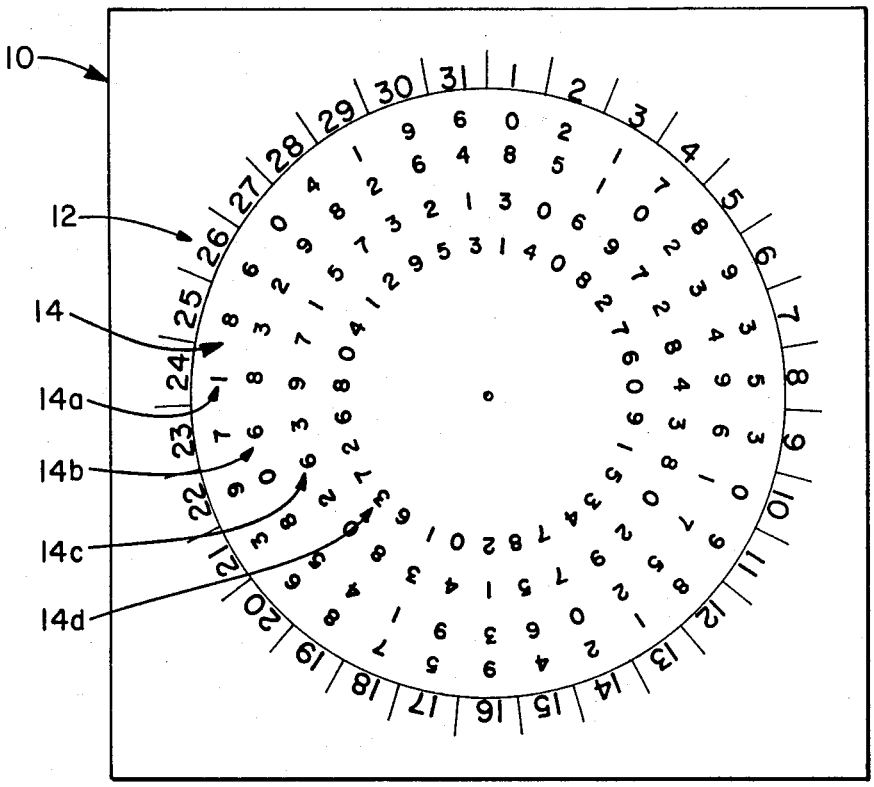
FIG. 1 is a plan view of the base of the number selection device of the invention.

FIG. 1 shows the base of the invention, indicated generally by the numeral 10, comprising a series of numbers printed in a disc-like pattern on a background material which may be of any convenient shape, for example, square, circular or other, or which may form part of the folio described hereinafter. Some of such numbers are arranged in a circle 12 at the outermost edge of the disc-like pattern, while others are placed radially in concentric circles, generally 14 in the Figure. The outermost numbers 12 may be numbered according to some predetermined sequences, as for instance, from one through thirty-one, representing the days of the month. Alternatively, they may be numbered from one through twelve, representing the months of the year, or a group of numbers may be selected in some other way, logical or illogical, in sequence or not, the purpose simply being to permit identification of a reference point on the base 10.

Figure 2:
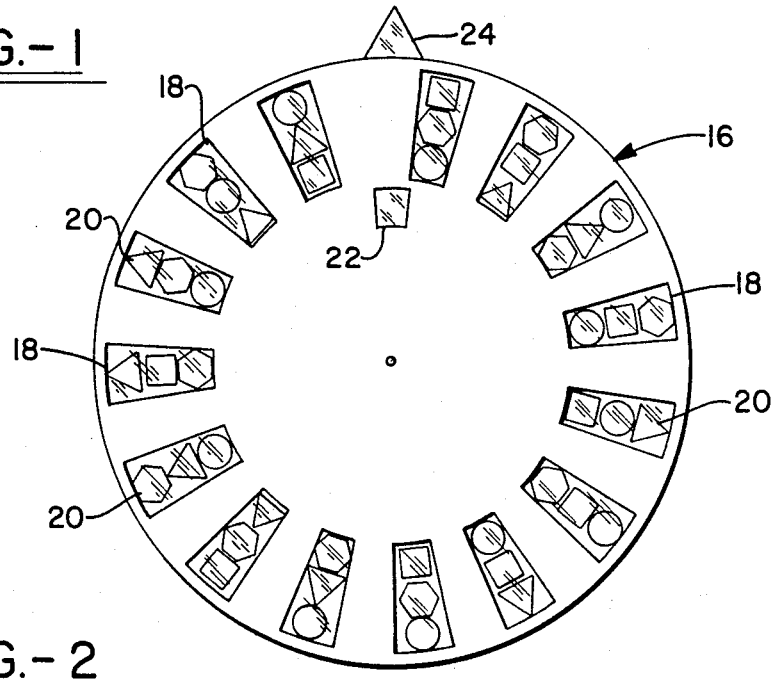
FIG. 2 is a plan view of the rotatable disc of the number selection device of the invention.
Figure 3:
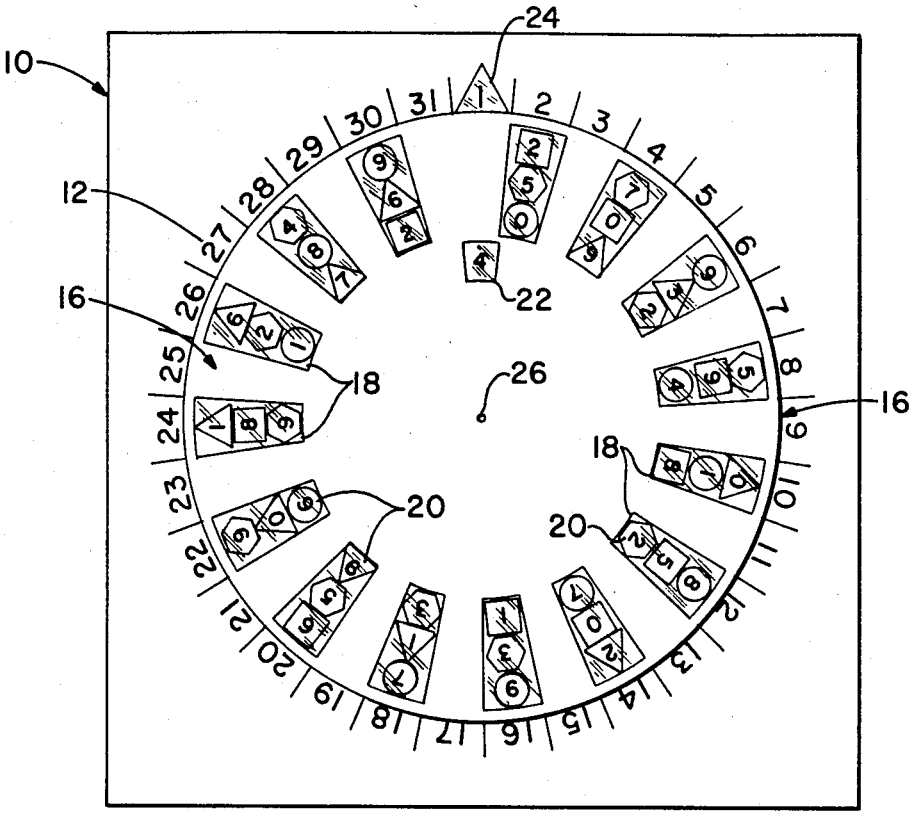
FIG. 3 is a plan view of the assembled number selection device of the invention.

The balance of the members in the disc-like pattern is better understood in connection with the discussion of FIGS. 2 and 3.

FIG. 2 shows a rotatable disc 16 fastened at its center by suitable means to the center of a base 10, and rotatable relative thereto. Disc 16 is provided with a plurality of cut-out window sections 18, arranged radially, which are equipped with transparent covers on which a number of enclosed designs 20 are printed, also in radial fashion, not more than one design of the same kind appearing in any one of such window sections. Such designs may include, for instance, circles, triangles, semicircles, squares, arrows, or others. The designs 20 are printed in a plurality of colors, and each of the different designs in any particular window has a number of identical counterpart designs of the same colorin some of the other windows.

Disc 16 also may contain a window section 22 in its central portion, on which no enclosed design is presented, and it contains a number indicator which may be a pointer 24.

As indicated, the window sections 18 are overlayed with a transparent cover which may be cellophane or some other transparent plastic sheet material adapted to having enclosed designs printed thereon. When present, window section 22 may also be so covered, but need not be. The window sections may be individually covered; alternatively, and more simply, however, the transparent covering may comprise a disc of the transparent material substantially the same size as, and fastened to disc 16, for example, by a suitable adhesive.

FIG. 3 shows the assembled number selection device comprising disc 16 fastened to base 10 by suitable fastening means 26, which may be a rivet, pin, paper fastener or the like, in such a way as to permit the disc to be rotated relative to the base.

As can be seen from FIG. 3, the numbers, in concentric circles 14*a*, 14*b* and 14*c* of FIG. 1 may be seen through windows 18, while the numbers in concentric circle 14*d* appear in window 22. The enclosed designs 20 provided are large enough so that the numbers in circles 14*a*, 14*b* and 14*c* clearly visble therethrough.

A number selection is made with the device by rotating disc 16 until pointer 24 rests on an appropriate reference point, which may be the day of the month, on base 10. The user then makes a choice first of a particular enclosed design, and second of a certain color, for example, red, blue, green, etc. All numbers within the chosen shape of the determined color constitute selected numbers, as does the number in window 22, if required.

The sequence of the numbers chosen will depend upon the preference of the user. The sequence might, for example, be determined by reading the numbers clockwise from the pointer 24, with the number in window 22, when used, being last. Of course, a different system for choosing a sequencing order might also be chosen.

Numerous variations of the number selection device are feasible. For instance, while one window 22 is shown, more than one such window, or none, might be provided. Similarly, while three enclosed designs 20 are shown disposed in each of the windows 18, more or fewer such designs could be radially disposed within such windows. Also, while fifteen windows 18 are shown in the embodiment illustrated, more or less windows could be employed provided that the numbers on the base 10 and the windows 18 are coordinated so that numbers appear in the enclosed designs when the number indicator 24 is pointed at a reference point such as a number in circle 12. Similar coordination is required with respect to window 22. The number of colors used may also vary, it only being necessary that the windows, colors, and designs be such that the number of digits required by the rules of the lottery game being played can be selected.

The size of the disc 16 may also vary, and will normally be selected based on considerations of convenience. In the case of the embodiment illustrated in the accompanying figures, which employ five enclosed designs 20, three design colors, fifteen windows 18, and one window 22, a particularly useful disc will be one having a diameter of about five to six inches. Such a disc has been found to be easy to use, since the numbers provided can be made large enough to be easily read.

Figure 4:
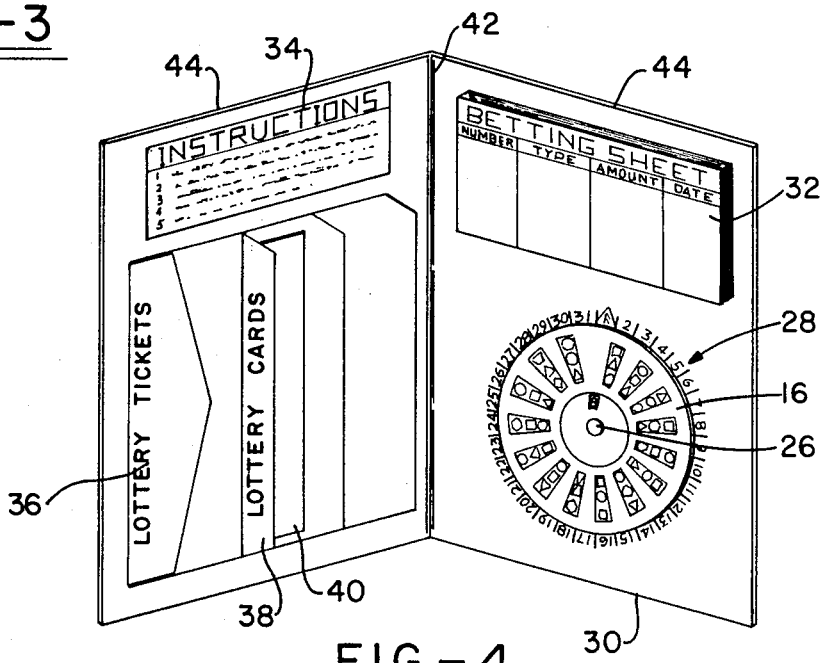
FIG. 4 is a perspective view of the folio holder and included accessories used in connection with the lottery wagering kit of the invention.

FIG. 4 shows a preferred embodiment of the invention in which disc 16 of the number selection device, referred to generally by numeral 28, is fastened to a folio folder 30 by fastener 26. Also affixed to the folio is a pad of betting record sheets 32, and a set of operating instructions for using the number selection device 34. In addition, there are attached to folio 30 an envelope 36 for holding lottery ticket receipts, and file pockets 38 which are used to contain other lottery material such as lottery cards 40. The folio 30 can be folded at seam 42 so that all the lottery paraphernalia is securely enclosed between covers 44, the whole forming a convenient unitized wagering kit. While the folio may vary in size, a folio about eleven to twelve inches high, and seven to eight inches wide when folded, is easily used.

It should be understood, however, that the number selection device need not be contained in a folio kit, but may simply comprise a disc mounted to a suitable base.

What is claimed is:

1. A number selection device comprising in combination:

a base on which numbers are printed in a plurality of concentric circles, at least some of said numbers being radially aligned, and a disc having a plurality of window openings therein, comprising elongated, radially disposed window openings covered with a transparent film, the film over said elongated window openings being furnished with a plurality of different designs disposed radially thereon, certain of said designs appearing in a color different from the color of certain other of said designs, wherein said disc has a number indicator on its periphery, said disc being of smaller diameter than the outermost concentric circle of numbers on said base, and wherein said base and said disc are rotatably connected relative to each other at their respective centers, said base, window openings, designs, and numbers being so located relative to each other that numbers on the base may be made to appear for observation within said window openings and within said designs when said disc is properly mechanically rotated relative to said base.

2. A number selection device according to claim 1, the base of which contains at least five concentric circles of imprinted numbers, the numbers on at least three of said circles adjacent to each other being radially aligned with each other.

3. A number selection device according to claim 1 wherein said disc contains at least one window opening which contains no transparent film having a design thereon.

4. A number selection device according to claim 3, the base of which contains five concentric circles of numbers the numbers on the middle three of said circles being radially aligned with each other, while the numbers on the innermost and outermost circles are also aligned with each other.

5. A number selection device according to claim 4 in which each of the circles of numbers has thirty-one numbers, and wherein the film on no individual one of said elongated windows has a design repeated on it, each of said designs being randomly selected from a group of five different designs.

6. A number selection device according to claim 5 in which the outermost circle of numbers on the base are sequentially numbered, while the numbers in the other circles of numbers are randomly selected.

7. A number selection device according to claim 1 which further comprises a folio to which said base is attached, and a pad of betting record sheets, a set of instructions for operating said number selection device, and a plurality of holders for holding lottery material attached to said folio.

* * * * *